US008528662B2

(12) United States Patent
Camp

(10) Patent No.: US 8,528,662 B2
(45) Date of Patent: Sep. 10, 2013

(54) POSITION INDICATOR FOR DRILLING TOOL

(75) Inventor: David M Camp, Houston, TX (US)

(73) Assignee: Amkin Technologies, LLC, Houston, TX (US)

( * ) Notice: Subject to any disclaimer, the term of this patent is extended or adjusted under 35 U.S.C. 154(b) by 163 days.

(21) Appl. No.: 12/428,455

(22) Filed: Apr. 22, 2009

(65) Prior Publication Data

US 2009/0266611 A1 Oct. 29, 2009

Related U.S. Application Data

(60) Provisional application No. 61/125,193, filed on Apr. 23, 2008.

(51) Int. Cl.
*E21B 25/16* (2006.01)

(52) U.S. Cl.
USPC ..... 175/45; 175/61; 702/151

(58) Field of Classification Search
USPC ..... 175/61, 45, 40, 74; 73/660, 114.26; 702/151
See application file for complete search history.

(56) References Cited

U.S. PATENT DOCUMENTS

| | | | | |
|---|---|---|---|---|
| 3,983,948 | A | 10/1976 | Jeter | |
| 4,371,958 | A | 2/1983 | Claycomb | |
| 4,899,833 | A | 2/1990 | Warren et al. | |
| 4,948,925 | A | 8/1990 | Winters et al. | |
| 4,995,465 | A | 2/1991 | Beck et al. | |
| 5,103,919 | A | 4/1992 | Warren et al. | |
| 5,259,468 | A | 11/1993 | Warren et al. | |
| 5,735,357 | A | 4/1998 | Palm | |
| 5,894,896 | A | 4/1999 | Smith et al. | |
| 6,158,529 | A * | 12/2000 | Dorel | 175/61 |
| 6,170,573 | B1 | 1/2001 | Brunet et al. | |
| 6,192,748 | B1 | 2/2001 | Miller | |
| 6,349,767 | B2 | 2/2002 | Gissler | |
| 6,419,014 | B1 | 7/2002 | Meek et al. | |
| 6,536,531 | B2 | 3/2003 | Brunet | |
| 6,550,548 | B2 * | 4/2003 | Taylor | 175/45 |
| 6,571,888 | B2 | 6/2003 | Comeau et al. | |
| 6,763,900 | B2 | 7/2004 | Miszewski | |
| 6,955,231 | B1 | 10/2005 | Bakke | |
| 7,243,739 | B2 | 7/2007 | Rankin, III | |
| 7,270,198 | B2 | 9/2007 | Camp | |
| 7,467,672 | B2 | 12/2008 | Cruickshank | |
| 7,556,105 | B2 * | 7/2009 | Krueger | 175/45 |
| 7,721,826 | B2 * | 5/2010 | Hall et al. | 175/74 |
| 2005/0194183 | A1 | 9/2005 | Gleitman et al. | |
| 2007/0151767 | A1 * | 7/2007 | Downton | 175/73 |

* cited by examiner

*Primary Examiner* — Shane Bomar
*Assistant Examiner* — Kipp Wallace
(74) *Attorney, Agent, or Firm* — Mark A. Oathout; Oathout Law Firm

(57) ABSTRACT

A position indicator for use in a dowhole tool and method for use is provided. The position indicator has a sensor that detects the position of a portion of the tool as the tool rotates. The sensor sends a signal to a controller to relay the position of the tool to a controller and/or operator. The rotational position of the tool may be controlled in order to perform downhole operations.

18 Claims, 7 Drawing Sheets

POSITION INDICATOR FOR DRILLING TOOL

CROSS-REFERENCE TO RELATED APPLICATION

This application claims the priority benefit of U.S. provisional patent application No. 61/125,193, titled "Radial Position Indicator of Rotating Drilling Tool," filed Apr. 23, 2008 with the inventor David Camp. This related application is hereby incorporated by reference in its entirety.

BACKGROUND

Embodiments of the inventive subject matter generally relate to the field of drilling tools, more particularly, to a position indicator for determining a position of a downhole tool.

Conventional directional drilling with jointed pipe is accomplished through use of a Bottom Hole Assembly (BHA) consisting of a bent housing or bent sub, a power section, a drill bit, and a directional Measurement While Drilling (MWD) tool. The drilling motor is typically located between the bent housing and the drill bit. The curved portion of the wellbore is drilled by rotationally fixing the drill string at the surface and rotating the drill bit with the drilling motor. The bent housing will slowly cause the wellbore to bend as the drill string is lowered into the earth with the bit rotating and drilling. To control the radial orientation of the wellbore, the rotation of the drill string is controlled and manipulated at the surface.

SUMMARY

Embodiments described herein include a position indicator for use in a downhole tool. The position indicator comprises a mandrel configured to rotate in a wellbore and a plurality of upsets coupled to a portion of the mandrel. The position indicator may further comprise a sensor configured to detect each of the upsets as the upset rotates past the sensor and a signal sent from the sensor to a controller wherein the signal is configured to represent the rotational position of one or more of the upsets.

Embodiments described herein include a method for determining the position of a downhole tool. The method comprising rotating a drive train using a downhole motor and rotating the downhole tool with the drive train. The method further comprising sensing the rotation of the downhole tool by determining the position an upset on the downhole tool as the upset rotates past a sensor, and transmitting the rotational position of the downhole tool to a controller.

BRIEF DESCRIPTION OF THE DRAWINGS

The present embodiments may be better understood, and numerous objects, features, and advantages made apparent to those skilled in the art by referencing the accompanying drawings.

DESCRIPTION OF EMBODIMENT(S)

The description that follows includes exemplary apparatus, methods, techniques, and instruction sequences that embody techniques of the present inventive subject matter. However, it is understood that the described embodiments may be practiced without these specific details.

Embodiments described herein comprise an apparatus and method for detecting and monitoring the rotational position of a downhole tool during use in a wellbore. The apparatus comprises a conveyance for conveying a bottom hole assembly (BHA) into a wellbore. The BHA may include a motor and/or power section, a drill bit, a drive train connecting the drill bit to the motor, a bent housing, a shifting apparatus, and a position indicator. The motor transfers rotational motion to the drill bit, thereby allowing the BHA to drill the wellbore. The shifting apparatus may allow for rotation to be transferred to the bent housing in order to rotate the bent housing downhole. The rotation of the bent housing allows the operator to change the direction of the drilling without needing to pull the entire BHA out of the wellbore. The position indicator allows the operator to determine the position of the bent housing as it rotates due to the motor rotation. The position indicator may send a signal to a controller and/or an operator which allows the operator to determine the position of the bent housing. When the bent housing is in a desired rotational position the operator may disengage the shifting apparatus from the bent housing thereby fixing the rotational position of the bent housing relative to the motor. The drilling operation may then proceed with the bent housing in the fixed position. As drilling continues with the rotation of the bent housing fixed, a deviated, or directed, wellbore is formed.

Figure 1:
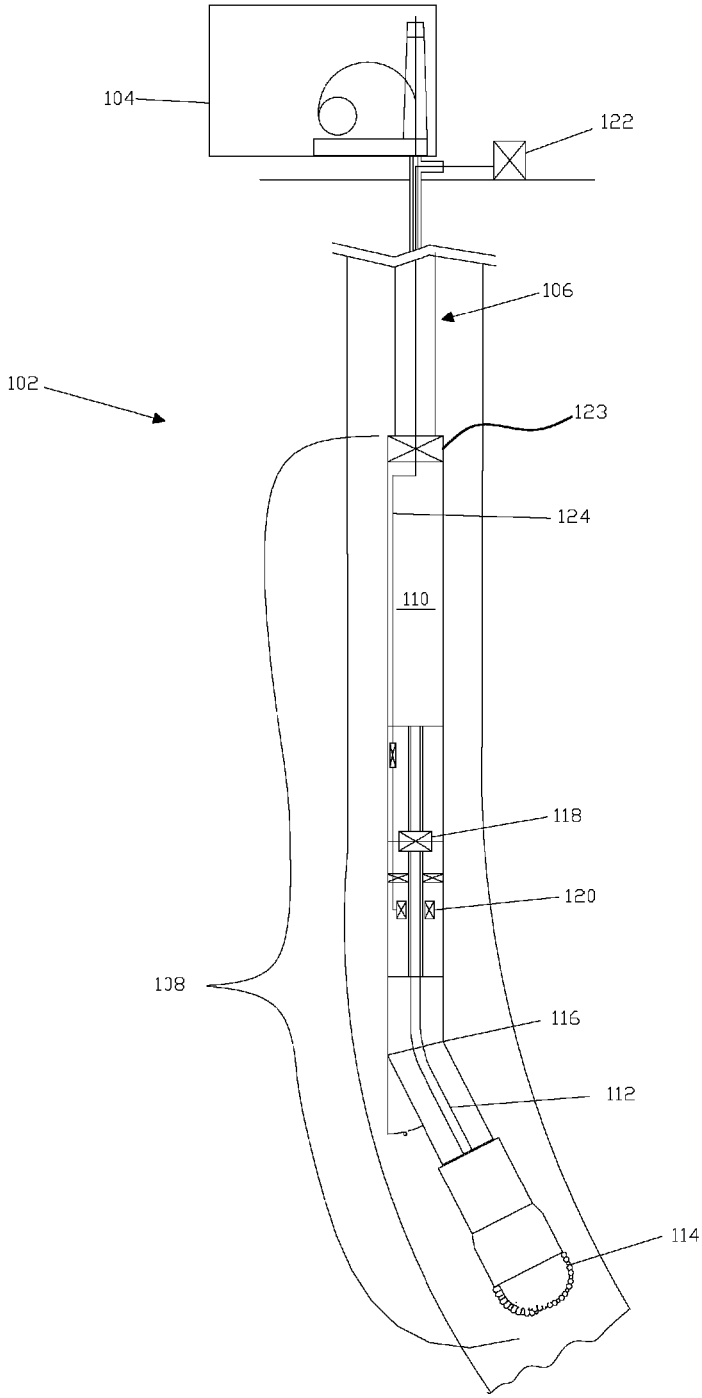
FIG. 1 depicts a diagram illustrating a schematic view of a wellbore in an embodiment.

FIG. 1 depicts a schematic view of a wellbore 100 having a downhole tool 102 according to an embodiment. The downhole tool 102 may include a delivery system 104, a conveyance 106 and a bottom hole assembly (BHA) 108. The delivery system 104 delivers the conveyance 106 and the BHA 108 into the wellbore 100. The conveyance may be any suitable system for conveying the BHA 108 into the wellbore 100. The BHA 108 may include a motor 110, a drive train 112, a drill bit 114, a bent housing 116, or bent sub, a shifting apparatus 118 and a position indicator 120 in an embodiment described herein. The motor 110 may rotate the drill bit 114 using the drive train 112. When the position of the bent housing 112 needs to be adjusted to control the drilling direction, the operator may use the shifting apparatus 118 to rotationally couple the bent housing 116 to the motor 110. The position indicator 120 may detect the rotational position of the bent housing 116 as the bent housing rotates. The detected rotational position of the bent housing 116 may be sent to a controller 122, and/or operator via a communication signal 124. When the bent housing 116 is in the proper position the shifting apparatus 118 may disengage the bent housing 116 from the motor 110 thereby fixing the position of the bent housing 116 relative to the motor 110. The drilling operation may continue with the bent housing 116 in the fixed position.

The conveyance 106 may be any suitable conveyance for delivering the BHA 108 into the wellbore. In an embodiment, the conveyance 106 is a coiled tubing. Coiled tubing is tubing which is wound on a drum, or spool, (not shown). The coiled tubing may be fed into the wellbore 100 as the tubing is unwound from the drum. Coiled tubing is advantageous in that no pipe joints have to be assembled, or disassembled, while the conveyance 106 is being run into or pulled out of the wellbore 100. The tubing is simply unwound into the wellbore 100. When forming a wellbore, the use of coiled tubing for drilling saves rig time versus wellbores drilled with jointed pipe. However, it is difficult to transfer rotation to a downhole tool, or BHA 108, through the coiled tubing due to the continuous nature of the tubing. Although the conveyance 106 is described as a coiled tubing, it should be appreciated that the conveyance 106 may be any suitable system for delivering a BHA 108 into and out of the wellbore including, but not limited to, a drill string, a casing string, a wire line, a slick line, a polyethylene pipe, a polymer drill pipe, a PVC pipe, FIBERSPAR® and the like.

The delivery system 104 may be any suitable system for delivering the conveyance 106 and thereby the BHA 108 into and out of the wellbore 100. In an embodiment, the delivery system 104 is a coiled tubing injection system. The coiled tubing injection system may include a mobile platform for transporting the spool, or drum, and/or the coiled tubing. The injection system may grasp the coiled tubing and exert a linear force on the coiled tubing in order to feed the tubing into the wellbore 100. Although the delivery system 104 is described as a coiled tubing injection system, it should be appreciated that the delivery system 104 may be any suitable delivery system including, but not limited to, a drilling rig for assembling drill strings and/or casing strings, and the like.

The BHA 108 may connect to the lower end of the conveyance 106 with a connector 123. The connector 123 may be any suitable connector to prevent the BHA 108 from becoming inadvertently disengaged from the conveyance 106. For example, the connector 123 may be a threaded connection having a box end and a pin end. Further, the connector 123 may be a releasable or frangible connection adapted to selectively release the BHA 108 from the conveyance 106 in the event the BHA 108 becomes stuck in the wellbore 102. Although the connector 123 is described as a threaded connection it should be appreciated that the connector 123 may be any suitable connection for coupling the conveyance 106 to the BHA 108 including, but not limited to, a pin connection, a welded connection, and the like.

The BHA 108 may further include the motor 110. The motor 110 is configured to produce torque, or rotational power, downhole in the BHA 108. In an embodiment, the motor 110 is a mud motor of a mouniea style. The mud motor produces rotational power from the flow of drilling fluid, or mud, through a fluid flow passage in the motor 110. The mud motor may include a rotor and a stator to produce the rotational power. Although the motor 110 is described as a mud motor, it should be appreciated that the motor 110 may be any suitable motor, or device for producing torque, or rotational power in the BHA 108 including, but not limited to, an electric motor, an electric motor powered by an electric generator coupled to a downhole fluid motor, a turbine, an air motor, a top drive for rotating a portion of the conveyance, a pipe spinner, and the like.

The motor 110 may be located above the bent housing 112 and the drill bit 114, in an embodiment described herein. The location of the motor 110 above the bent housing 116 may require rotation to be transferred to the drill bit 114 through and independent of the bent housing 112. Thus, the motor 110 above the bent housing 116 may rotate the drill bit 114 while the bent housing 116 remains in a rotationally stationary position relative to the motor 110. Further, the BHA 108 may be configured to selectively engage the bent housing 112 thereby transferring torque to the bent housing 116 as will be described in more detail below. It should be appreciated that the motor 110 may be located at any location above the BHA 108, including the earth's surface, so long as the motor 110 is capable of transferring torque to the BHA 108.

In an alternative embodiment, there may be more than one motor 110. For example, there may be one motor located above the BHA 108 configured to orient the bent housing 116 and one motor located between the bent housing 116 and the drill bit 114 and configured to rotate the drill bit 116.

In yet another alternative embodiment, there may be one motor 110 located between the bent housing 116 and the drill bit 114. In this example, the motor may be adapted to rotate the drill bit 114 and selectively engage the bent housing thereby rotating the bent housing 116 relative to the conveyance 106.

The BHA 108 may include the drive train 112. The drive train 112 may be configured to transfer torque from the motor 110 to the drill bit 114. The drive train 112 may be any component, or combination of components, capable of transferring torque to the drill bit 114. In an embodiment, the drive train may be one or more shafts or pipes coupled together. A portion of the shaft may be coupled directly to the motor 110, or there may be an intermediate component between the shaft and the motor 110. The intermediate component may allow for a more flexible connection between portions of the drive train 112. For example, it may be necessary to transfer rotation from a rotor to the drive train. The rotor may rotate and move slightly in the longitudinal and/or radial direction as it rotates, such as a rotor moves in a stator. The intermediate component in this case dampens the longitudinal and/or radial movement to the shaft while still transferring the rotation, or torque. Further, the intermediate connection may allow for the transfer of rotation in components which are not straight, for example the bent housing 116. Thus, the intermediate component may bend within the bent housing 116 thereby allowing rotation to be transferred from the top end of the bent housing 116 to the bottom end. The intermediate component may be any component suitable for transferring rotation from the motor 110 to the shaft, for example a splined connection, a universal joint, a CV joint and the like. The drive train 112 may include any number of intermediate components between the drill bit 114 and the motor 110 so long as the torque from the motor 110 is transferred to the drill bit 114.

The drive train 112 may be configured to continuously transfer torque to the drill bit 114 when the motor 110 is rotating in an embodiment. Further, the drive train 112 may be configured to selectively transfer rotation to the bent housing 116, as will be described in more detail below. In an alternative embodiment, the drive train 112 may be configured to selectively disengage from the motor 110, and/or the drill bit 114 in order to halt drilling operations if necessary.

The drill bit 114 may be any tool configured to remove rock, soil, sand, and like while boring the wellbore 100. The drill bit 114 may be any suitable type of drill bit including, but not limited to, a roller cone bit, a polycrystialline diamond compact (PDC) drill bit, a coring bit, a drag bit and the like.

The bent housing 116 may be configured to direct the path of the wellbore 100 during directional drilling operations. The bent housing 116 typically has a slight angled bend Θ. When the bent housing 116 is held in a rotationally stationary position the wellbore 100 will be drilled at a slight angle, from the direction of the conveyance 106. Thus, as drilling is continued with the bent housing 116 in one rotational position, the wellbore 100 will be directed, or deviated, in one direction. To drill in another direction, the bent housing 116 may be rotated relative to the longitudinal axis of the conveyance 106 to a second position. The operator may then drill in the second direction in a similar manner as described above. To drill in a substantially straight line, the bent housing 116 may be rotated while rotating the drill bit 114, thereby continuously changing the direction the drill bit 114 drills. The continuous directional change of the drill bit 114 causes the drill bit 114 to bore, or drill out, a larger diameter wellbore corresponding to the rotation of the bent housing 116. Further, to drill in a straight line, the BHA 108 may be removed from the wellbore and the bent housing may be removed, or the BHA 108 may be replaced with a straight BHA 108, not shown. Further still, the bent housing 116 may be configured to straighten downhole automatically, and/or in response to instructions from the controller or operator.

Figure 2:
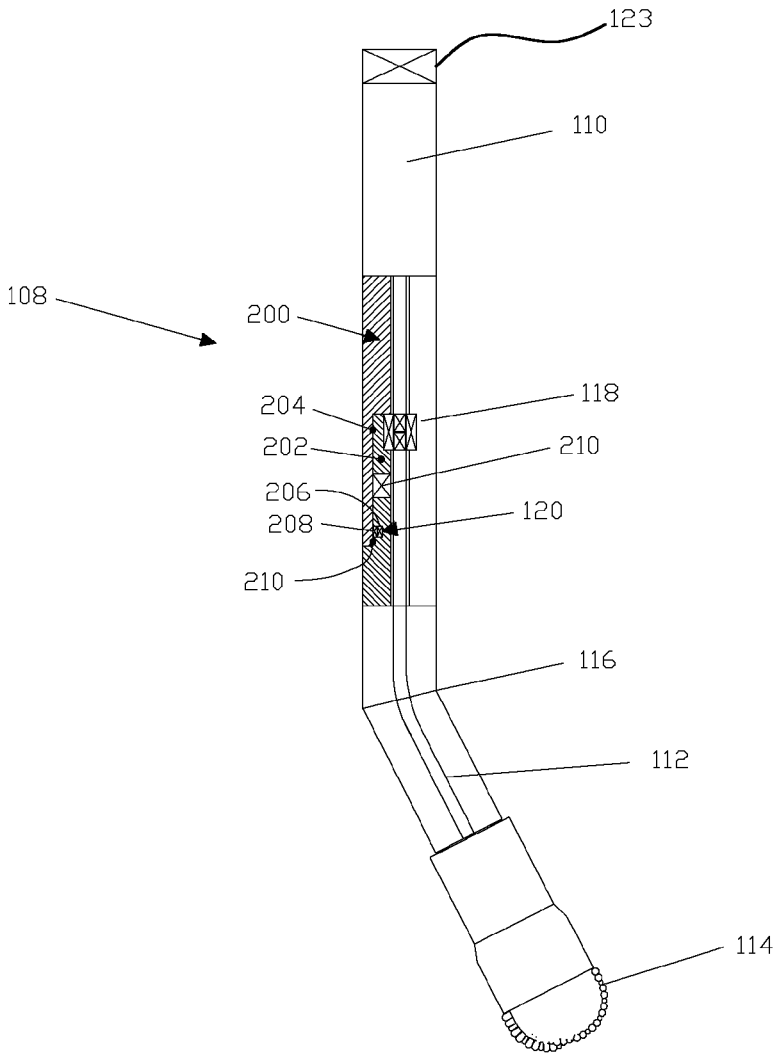
FIG. 2 depicts a diagram illustrating a schematic view of a bottom hole assembly (BHA) in an embodiment.

To rotate the bent housing 116 relative to the BHA 108 the shifting apparatus 118, shown schematically in FIGS. 1 and 2, couples the drive train 112 and/or the motor 110 to the bent housing 116. FIG. 2 depicts a schematic view of the BHA 108 showing the shifting apparatus 118 and a cross sectional view of one or more mandrels configured to rotate the bent housing 116. In an embodiment, there may be one or more stationary mandrels 200. The stationary mandrels 200 remain rotationally stationary relative to the BHA 108 during drilling and orienting of the bent housing 116. There may be one or more rotating mandrels 202. The rotating mandrel(s) 202 may be configured to selectively engage the drive train 112 via the shifting apparatus 118. With the rotating mandrel 202 engaged with the drive train 112, the motor rotates the rotating mandrel 202. A portion of the rotating mandrel may 202 be coupled to the bent housing 116. Thus, the shifting apparatus 118 may selectively engage the rotating mandrel(s) 202 and transfer rotation from the drive train 112 to the bent housing 116.

The rotating mandrel(s) 202 may rotate in close proximity to a portion of the stationary mandrel 200. For example, a portion of the rotating mandrel 202 is shown located on the interior of a portion of the stationary mandrel 200 in FIG. 2. There may be one or more seals 204, or o rings, between the rotating mandrel 202 and the stationary mandrel 200 to prevent fluid from entering, or leaving the space between the mandrels. The stationary mandrle(s) 200 may serve as a housing for the rotating mandrel(s). Thus, the stationary mandrel 200 may protect the rotating mandrel(s) 202 from exposure to the downhole environment. The rotating mandrel(s) 202 may be connected to the bent housing 116 using any know connection such as a threaded connection, a welded connection and the like. Further, the rotating mandrel(s) 202 may be integral with the bent housing 116.

The position indicator 120 indicates the rotational position of the rotating mandrel 202, and thereby the bent housing 116, as the rotating mandrel 202 rotates relative to the stationary mandrel(s) 200. The position indicator 120 may include one or more upsets 206, or position marks, which move with the rotating mandrel 202 as the mandrel, and thereby the bent housing 116 rotates. A sensor 208 may be stationary and coupled to the stationary housing 200. The sensor 208 may detect one or more of the upsets 206 as the upsets rotate past the sensor 208. Thus, as the rotating mandrel 202 rotates relative to the stationary mandrel 200, the sensor 208 detects the rotational position of the rotating mandrel 202 by detecting the one or more upsets 206. Therefore, the sensor 208 detects the rotational position of the bent housing 116 as it rotates by detecting the upsets 206. Although the upsets 206 are described as being located on the rotating mandrel 202 and the sensor 208 is described is being located on the stationary mandrel 200, it should be appreciated that the upset 206 may be located on the stationary mandrel 200 and the sensor 208 may be located on the rotating mandrel 202. Further, the upsets 206 may be located directly on the bent housing 116.

The rotational speed of the motor 110 may be faster than desired for rotating the bent housing 116. Therefore, there may be one or more speed reducers and/or one or more gears 210 connected to a portion of the rotating mandrel(s) 202. The one or more gears 210 may be any device suitable for reducing the rotational speed of the rotational mandrel 202, and/or the bent housing 116 including, but not limited to, a planetary gear, a series of spur gears, a helical gear, and the like.

Figure 3:
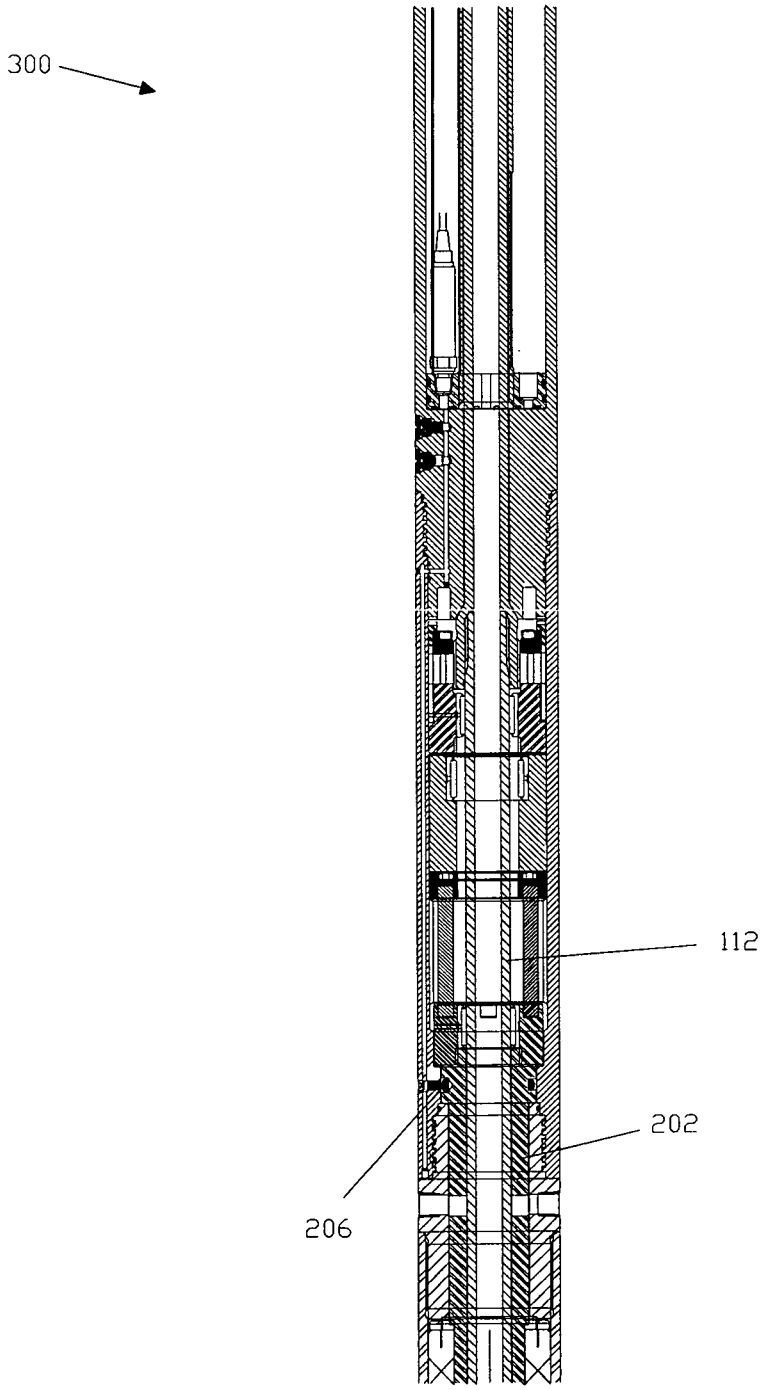
FIG. 3 depicts a diagram illustrating a cross sectional view of a portion of the BHA in an embodiment.

The shifting apparatus 118 may be any device capable of selectively coupling the drive train 112 to the bent housing 116 and/or the rotating mandrel 202. In an embodiment shown in FIG. 3, the shifting apparatus is a clutch 300, or clutch works. Although the shifting apparatus is described as a clutch 300, it should be appreciated that the shifting apparatus 118 may be any suitable apparatus for selectively engaging the bent housing 116 including, but not limited to slips, a splined member, and the like. The shifting apparatus 118 may be actuated by any suitable device including but not limited to a mechanical actuator, a hydraulic actuator, a pneumatic actuator, a linear actuator, a solenoid, an electric actuator and the like.

Figure 4:
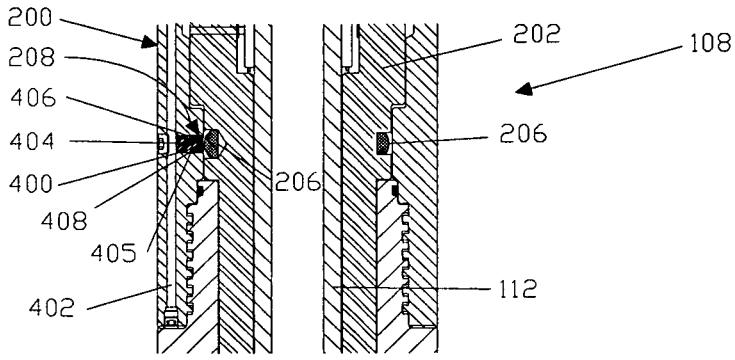
FIG. 4 depicts a diagram illustrating a cross sectional view of a portion of the BHA in an embodiment.

FIG. 4 shows a cross sectional view of the BHA 108 near the position indicator 120 according to one embodiment described herein. The upsets 206 are shown as a plurality of nodes coupled to, or integral with the rotating mandrel 202. The nodes engage a portion of the sensor 208 coupled to the stationary mandrel 200 as the rotating mandrel 202 rotates relative to the stationary mandrel 200. As shown in FIG. 4, the nodes engage a piston 400. When the nodes engage the piston 400 the piston 400 may move in a piston housing 405. The movement of the piston may send a signal which indicates the position of the node. The position of the node may be communicated to the controller 122, and/or the operator, via the communication signal 124.

Figure 5:
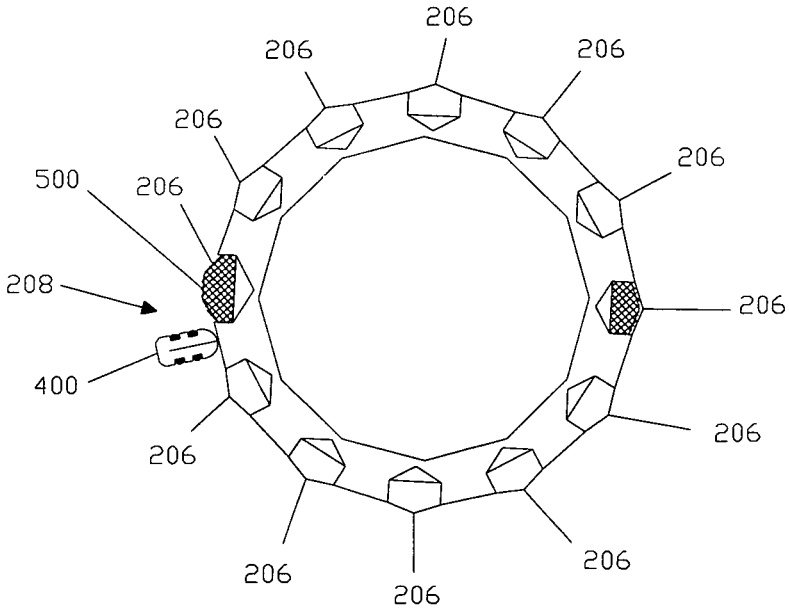
FIG. 5 depicts a diagram illustrating a cross sectional top view of a portion of the BHA in an embodiment.

FIG. 5 shows a cross sectional top view of the rotating mandrel 200 at the location of the upsets 206, in one embodiment. The upsets 206, or nodes, shown in FIG. 5 are equally sized with the exception of a test node 500. As the sensor 208 engages each of the upsets 206 the signal is sent to the operator, or the controller 122 indicating the presence of the node. When the test node 500 engages sensor 208, a larger signal may be sent to the controller 122, and/or operator indicating the sensor 208 has engaged the test node 500. The test node 500 may indicate to the operator a known position of the rotating mandrel 202 and/or the bent housing 116. For example, the test node 500 may be aligned with the direction of the bent housing 116. Thus, when the test node 500 engages the sensor 208, the operator and/or the controller 122 knows that the direction of the bent housing 116 was in line with the sensor 208. The test node 500 may have any form so long as it sends a signal that does not conform with the other upsets 206. For example, the test node 500 may be smaller than the upsets 206. The controller, and/or operator, may use the test node 500 as a basis for orienting the bent housing 116. As the rotating mandrel 202 continues to rotate past the sensor, each of the upsets encountered represent a known degree of rotation. Thus, the controller 122, and/or operator may count each upset as it passes in order to determine the rotational position of the rotational mandrel 202 and the bent housing 116. Although the upsets 206 are shown as extending radially beyond rotating mandrel 202 it should be appreciated that the upsets may take any shape capable of being detected by the sensor. For example the upsets may be an indent in the rotational mandrel, a boss, a bump, any combination thereof, and the like.

In another example, each of the upsets may have a variant size. Thus, each of the upsets 206 would indicate a specific rotational position of the rotating mandrel 202 and the bent housing 116. The controller 122 and/or operator would know the exact rotational location of the bent sub 116 from the signal received from the specifically sized upset 206.

Figure 6:
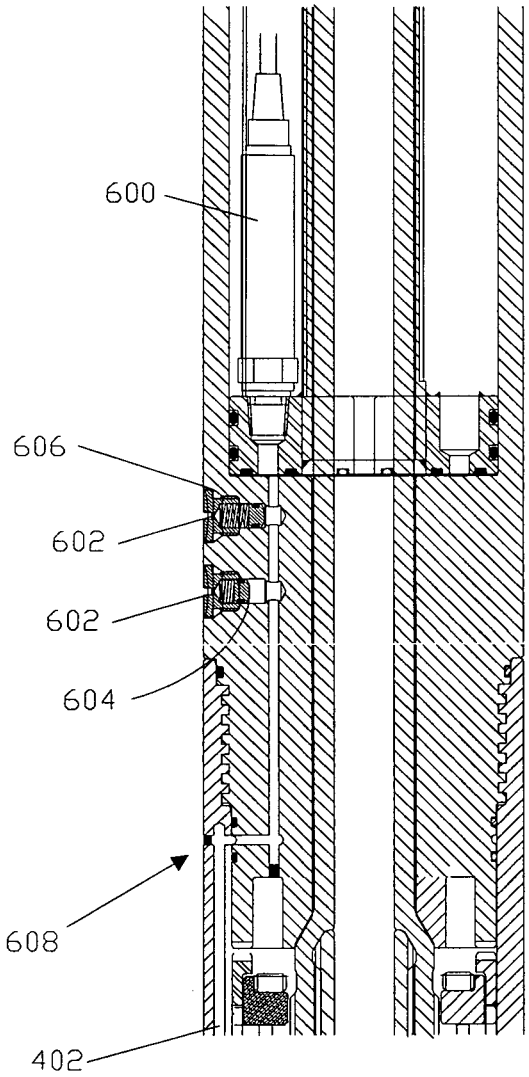
FIG. 6 depicts a diagram illustrating a cross sectional view of a portion of the BHA in an embodiment.

The sensor 208, as shown in FIGS. 4-6, includes the piston 400 and piston housing 405, a transmission path 402, and a gauge 600. The piston 400 may have a piston surface 404, an engagement surface 406 and one or more seals 408. The piston surface 404 may be configured to apply a force to the piston 400 in response to fluid pressure on the piston surface 404. The force caused by the fluid pressure may bias the piston 400 toward the rotating mandrel 202. The biasing of the piston 400 toward the rotating mandrel 202 may cause the engagement surface 406 to engage the outer surface of the rotating mandrel 202 and the upsets 206 as the rotating mandrel 202 rotates. Although the piston 400 is described as being biased toward the rotating mandrel 202 with the fluid pressure, it should be appreciated that the piston may be biased using any biasing member including but not limited to, a coiled spring, a leaf spring, an elastic member, and the like. The one or more seals 408 may be any seal so long as they substantially prevent fluid from flowing past the piston trough the piston housing 405.

The transmission path 402 may be any communication path for sending information, including a fluid signal, a fluid path, an electric signal, an optical signal and the like. In one embodiment, the transmission path is a fluid path which may be configured to send a signal to the gauge 600, shown in FIG. 6. The transmission path 402 may be filled with hydraulic, or pneumatic fluid, through which the signal is sent in response to the movement of the piston 400. As the piston 400 moves in response to engaging the one of the upsets 206, the fluid pressure in the transmission path 402 will change as a result. For example, if the upsets 206 are configured to move the piston 400 against the biasing force, the fluid pressure in the transmission path 402 will increase in the transmission path 402. If the upsets 206 are configured to move the piston 400 with the biasing force, the fluid pressure in the transmission path 402 will decrease in the transmission path 402. The increase, or decrease, in fluid pressure may be configured to travel as a signal through the entire transmission path 402.

Figure 7:
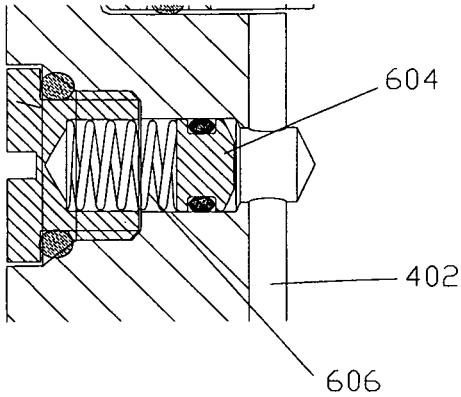
FIG. 7 depicts a diagram illustrating a cross sectional view of a portion of the BHA in an embodiment.

The transmission path 402 may include one or more dampers 602, as shown in FIGS. 6 and 7. The dampers 602 may include a damping piston 604 and a biasing member 606. The biasing member 606 may bias the damping piston toward the transmission path 402, thereby applying a pressure on the fluid path 402. The dampers 602 may allow the pressure in the fluid path to adjust to volume, and/or pressure, changes in the fluid as a result of temperature change in the transmission path 402. Thus, as the temperature in the wellbore increases as the BHA 108 travels downhole, the volume of the fluid in the transmission path 402 may increase. The dampers 602 will adjust to the increase in volume. Further, if the fluid in the transmission path 402 is hydraulic fluid, the dampers 602 may absorb some of the pressure change in the fluid as a result of changes in temperature and/or movement of the piston 400.

Figure 8:
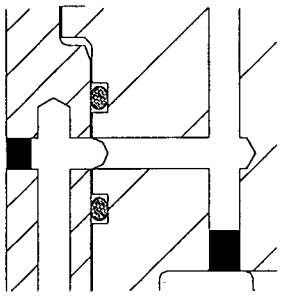
FIG. 8 depicts a diagram illustrating a cross sectional view of a portion of the BHA in an embodiment.

The transmission path 402 may further include one or more mandrel interconnectors 608, as shown in FIGS. 6 and 8. The mandrel interconnector 608 allows the transmission path 402 to pass from a first mandrel to a second mandrel. To this effect the mandrel interconnector 608 may include one or more seals. Further, if the first or second mandrel is a rotatable mandrel relative to the mandrel it is connected to there may be a flow path that allows for continuous fluid communication between the first mandrel and the second mandrel through the interconnector 608. Further, it should be appreciated that any signal may be sent across the interconnector 608. For example, the interconnector 608 may allow for an electrical signal to be sent through the interconnector 608.

In an embodiment, the transmission path 402 may couple to the gauge 600, as shown in FIG. 6. The gauge 600 may be any gauge capable of detecting pressure changes in the transmission path 402. Detecting the changes in pressure of the transmission path 402 allows the gauge to detect when the piston 400 engages the upsets 206. The detection of the upsets 206 may be converted into a signal by the gauge 600 that may be relayed to the controller 122, and/or the operator. The gauge 600, as shown in FIG. 6, is a gauge transducer. The gauge 600 sends, or transmits, the signal to the controller 122, and/or operator, via the communication path 124. Thus, as the bent housing 116 rotates relative to the BHA 108, the gauge 600 detects each of the upsets 206. The detection of each of the upsets 206 represents a rotational position of the bent housing 116. The detected position of the bent housing 116 may be sent to the controller 122. Although the gauge is described as a gauge transducer, it should be appreciated that the gauge may be any device capable of sending a signal to the controller, including an electric sensor.

The signal 124 sent to the controller 122 may be any signal capable of transferring information from the BHA 108 to the surface. In an embodiment, the signal 124 is sent via a wired connection to the surface. The signal 124 may be sent outside of the conveyance 106, inside the conveyance 106, in a wall of the conveyance 106 and any combination thereof. Although the signal 124 is described as a wired connection to the surface, it should be appreciated that the signal may be any signal capable of communicating the detection of the upsets 206 to the controller 122 including, but not limited to, a hydraulic signal, a pneumatic signal, mud pulse telemetry, telemetry, an electromagnetic signal, an RF signal, an acoustic signal, a wireless signal, a fiber optic signal, and the like.

There may be a lock system (not shown) configured to lock, or fix the bent housing 116 in a rotational position when the drive train 112 is not rotating the bent housing 116. The lock system may be any suitable method of securing the rotational position of the bent housing 116 including, but not limited to, a castle system, a ratchet, a pin, a clamp, the shifting apparatus and the like.

Although the sensor is describe as the piston 400 connected to the gauge 600 via the transmission path 402, it should be appreciated that the sensor, and/or position indicator 120 may be any suitable detection device including, but not limited to, an optical sensor, a strain gauge, a hall effect sensor and the like.

In operation, the BHA 108 is connected to the end of the conveyance 106. In one embodiment, the conveyance 106 is coiled tubing. The BHA 108 is lowered into the wellbore 100 until the BHA 108 reaches the bottom of the wellbore 100. The operator, and/or the controller 122 may then start the motor 110 in order to begin drilling the wellbore 100 deeper. In one embodiment, the operator starts the motor 110 by pumping fluids through the conveyance 106. The fluids may serve a dual purpose of powering the motor 110 and washing away drilling cuttings located near the drill bit 114. The motor 110 rotates the drive train 112 of the BHA 108. The drive train 112 may selectively transfer rotation to the drill bit 114 and/or the bent housing 116. The drive train may include one or more intermediate components configured to absorb non-rotational forces, and/or transfer rotation in a non-linear manner. If the operator wants to drill the wellbore 100 in a substantially straight line, the operator may rotate both the bent housing 116 and the drill bit 114. To rotate the bent housing 116, the shifting apparatus 118 is actuated thereby coupling the drive train 112 to the rotating mandrel 202. The rotating mandrel 202 may couple to the bent housing 116 thereby rotating the bent housing 116. The rotational speed of the drive train 112 may be too great for effectively rotating the bent housing 116. The rotation speed may be reduced in the rotating mandrel 202, and/or bent housing 116 by using one or more speed reducers, or gears 210. Thus, a substantially straight borehole may be drilled by continuously rotating the bent housing 116 and the drill bit 114 at the same time. The controller and/or operator may continue drilling in this manner until it is desired to deviate, or direct the wellbore 100 in another direction.

In an additional embodiment, the operator may drill in a straight line by indexing the direction of the bent housing 116 during drilling. Thus, the operator would drill with the bent housing 116 in a fixed position. Then after drilling for a distance, the operator may rotate the bent housing slightly and continue drilling with the bent housing in a fixed position. The operator may repeat this procedure during the entire drilling operation, thereby forming a wellbore which travels in substantially one direction.

In order to directional drill the bent housing 116 should be stationary and angled toward the desired drilling direction. The controller 122, and/or operator, may fix the bent housing 116 in a desired direction by using the position indicator 120 to determine the rotational position of the bent housing. As the bent housing 116 rotates, the nodes, or upsets 206, on the rotating mandrel 202 engage the piston 400. As the piston 400 moves in response to engaging the nodes, a pressure change is created in the transmission path 402. The pressure change in the transmission path may be sent to the gauge 600. The gauge 600 converts the pressure changes in the transmission path 402 into a signal which may be sent to the controller 122, and/or operator. Thus, the signal represents the rotational position of the bent housing 116 as each of the nodes pass the piston 400. The signal may be constantly sent to the controller or upon request. Using the signal, the controller 122, and/or operator, may monitor the rotational position of the bent housing 116 as it rotates downhole. Thus, operator may disengage the shifting apparatus 118 from the rotational mandrel 202, and/or the bent housing 116 when the signal corresponds to the desired drilling direction. Disengaging the shifting apparatus 118 from the rotating mandrel 202, and/or the bent housing 116, will disengage the drive train 112, and therefore the rotation, from the bent housing 116. With the bent housing 116 in the desired drilling direction, the operator and/or controller 122 may then continue the directional drilling operation. The drive train 112 rotates the drill bit 114 while the conveyance 106 continues to push the BHA 108 downhole thereby extending the wellbore 100. The rotationally fixed bent housing 116 directs the wellbore in the direction the operator want the wellbore 100 to be drilled. Upon completing the bend in the wellbore 100, the operator may continue drilling in a substantially straight line by reengaging the rotational mandrel 202 with the drive train 112. The operator and/or controller 122 may use the position indicator 120 to direct the wellbore 100 in any desired direction without removing the BHA 108 from the wellbore 100.

Although the BHA 108 is described above having a position indicator 120 for detecting the rotational position of a bent housing 116, it should be appreciated that the position indicator 120 may be used to rotationally position any downhole tool. For example, the position indicator 120 may be used rotationally position the face of a whipstock, not shown, in a desired direction before a lateral is drilled. Further, the position indicator 120 and portions of the BHA 108 may be used with any suitable downhole operation, or downhole tool including, but not limited to a fishing tool, a hammer, a whipstock, a rotary steerable, and the like.

Figure 9:
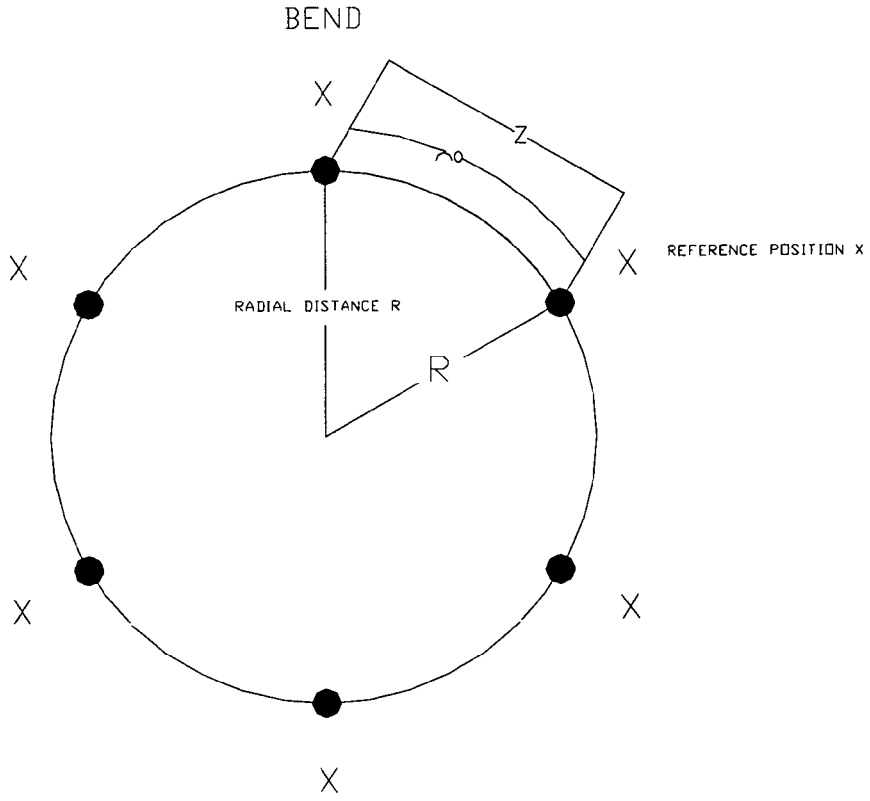
FIG. 9 depicts a geometric representation of the location of upsets detectable by a sensor on the downhole tool.

FIG. 9 depicts a geometric representation of the location of upsets detectable by a sensor on the downhole tool.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A position indicator for use in a bottom hole assembly, comprising:

a mandrel configured to rotate in a wellbore;

a plurality of upsets coupled to a portion of the mandrel;

a drill bit;

a downhole motor for rotating the drill bit;

a bent housing selectively rotatable by the downhole motor and configured to rotate with the mandrel;

a sensor configured to detect each of the upsets as the upset rotates past the sensor; and a signal sent from the sensor to a controller wherein the signal is configured to represent the rotational position of one or more of the upsets wherein the sensor further comprises a piston which engages each of the upsets as the upset moves past the piston.

2. The position indicator of claim 1, wherein the sensor further comprises a fluid path configured to fluidly couple the piston to a gauge transducer and wherein the gauge transducer detects the magnitude of the piston movement.

3. The position indicator of claim 2, further comprising one or more dampers coupled to the fluid path, wherein the one or more dampers are configured to absorb volume changes in the fluid path during operation of the position indicator.

4. The position indicator of claim 2, wherein the fluid path further comprises a hydraulic fluid.

5. The position indicator of claim 1, wherein the fluid path further comprises a pneumatic fluid.

6. The position indicator of claim 1, wherein the bent housing is located below the downhole motor and wherein the position indicator is configured to detect the rotational position of the bent housing relative to the downhole motor.

7. The position indicator of claim 6, wherein the drill bit is located below the bent housing and a drive train coupled to the downhole motor, wherein the drive train is configured to rotate the drill bit independently of the bent housing.

8. A position indicator for use with a downhole tool, comprising:

a rotatable mandrel configured to couple to the downhole tool and thereby rotate with the downhole tool;

a plurality of upsets coupled to a portion of the rotatable mandrel;

a piston configured to engage the rotatable mandrel and the upsets as the rotatable mandrel rotates;

a fluid path in fluid communication with the piston, wherein the fluid path is configured to have a change in fluid pressure in response to the piston engaging each of the upsets;

a sensor configured to detect the change in fluid pressure caused by the piston;

a signal sent from the sensor to a controller wherein the signal is configured to represent the rotational position of one or more of the upsets.

9. The position indicator of claim 8, further comprising one or more dampers coupled to the fluid path, wherein the one or more dampers are configured to absorb pressure changes in the fluid path during operation of the position indicator.

10. The position indicator of claim 9, wherein at least one of the one or more dampers comprises a biased piston.

11. The position indicator of claim 8, wherein the plurality of upsets are bumps on an exterior surface of the rotatable mandrel which extend radially away from the rotatable mandrel.

12. The position indicator of claim 8, wherein the plurality of upsets are indentations on an exterior surface of the rotatable mandrel which extend radially inward relative to the rotatable mandrel.

13. The position indicator of claim 8, wherein the plurality of upsets includes a test node, wherein the test node is configured to cause a larger change in pressure in the fluid path.

14. The position indicator of claim 8, wherein the sensor further comprises a gauge transducer.

15. A method for detecting a rotational position of a downhole tool, comprising:

rotating a mandrel and thereby rotating the downhole tool;

engaging an exterior surface of the mandrel with a piston;

moving the piston in response to the piston engaging a first upset on the exterior surface of the mandrel;

changing the fluid pressure in a fluid path in response to the moving piston;

sensing the change in fluid pressure thereby sensing the location of the first upset; and determining the rotational position of the downhole tool based on the sensed first upset.

16. The method of claim 15, further comprising moving the piston in response to the piston engaging a second upset on the exterior surface of the mandrel and moving the piston in response to the piston engaging the second upset.

17. The method of claim 16, further comprising detecting a larger change in pressure from the second upset than the first upset.

18. The method of claim 15, further comprising transmitting a signal to a controller.

* * * * *